US012637190B2

(12) United States Patent
Przybyl et al.

(10) Patent No.: US 12,637,190 B2
(45) Date of Patent: May 26, 2026

(54) OUTBOARD MARINE DRIVES HAVING SUPPORTING FRAME AND COWLING

(71) Applicant: Brunswick Corporation, Mettawa, IL (US)

(72) Inventors: Andrew J. Przybyl, Berlin, WI (US); Christopher J. Luckett, Stillwater, OK (US); Robert W. Egleston, Stillwater, OK (US); Umesh Muniswamy Sreenivasan, Bengaluru (IN)

(73) Assignee: Brunswick Corporation, Mettawa, IL (US)

( * ) Notice: Subject to any disclaimer, the term of this patent is extended or adjusted under 35 U.S.C. 154(b) by 688 days.

(21) Appl. No.: 17/984,440

(22) Filed: Nov. 10, 2022

(65) Prior Publication Data

US 2024/0158060 A1 May 16, 2024

(51) Int. Cl.
*B63H 20/02* (2006.01)
*B63H 20/32* (2006.01)

(52) U.S. Cl.
CPC ..... *B63H 20/02* (2013.01); *B63H 20/32* (2013.01)

(58) Field of Classification Search
CPC ..... B63H 20/00; B63H 20/02; B63H 20/32; B63H 1/00
See application file for complete search history.

(56) References Cited

U.S. PATENT DOCUMENTS 3,315,631 A 4/1967 Bass
4,066,032 A * 1/1978 Travis ..... B63H 23/24 440/6
5,487,687 A * 1/1996 Idzikowski ..... F02B 61/045 440/88 L
5,662,213 A 9/1997 Kattler
(Continued)

FOREIGN PATENT DOCUMENTS

DE 102017105904 9/2017
EP 4219290 A1 8/2023
(Continued)

OTHER PUBLICATIONS

Extended European Search Report issued in European Patent Application No. 23152367.1, dated Jul. 4, 2023.
(Continued)

*Primary Examiner* — Marc Burgess
(74) *Attorney, Agent, or Firm* — Andrus Intellectual Property Law, LLP

(57) ABSTRACT

An outboard marine drive includes a propulsor configured to generate a thrust force in water, and a monolithic supporting frame which supports the outboard marine drive relative to the marine vessel. The monolithic supporting frame includes a body, a support leg extending downwardly from the body and configured to support a propulsor housing for the propulsor, and a steering arm extending forwardly from the body for steering of the outboard marine drive. A power entry module coupled to the monolithic supporting frame, the power entry module being configured to regulate/control
(Continued)

current and voltage for powering the propulsor. A service tray is removably coupled to the top of the monolithic supporting frame, the service tray supporting at least one serviceable component of the outboard marine drive.

12 Claims, 14 Drawing Sheets

(56) References Cited

U.S. PATENT DOCUMENTS

| | | | | |
|---|---|---|---|---|
| 7,249,984 | B2 * | 7/2007 | Kobayashi | H01M 8/04201 440/6 |
| 8,337,264 | B2 | 12/2012 | Boebel | |
| 9,180,950 | B1 * | 11/2015 | Davenport | B63H 20/32 |
| 9,365,277 | B2 | 6/2016 | Skrzypchak et al. | |
| 9,701,383 | B1 | 7/2017 | Stuber et al. | |
| 9,963,213 | B1 | 5/2018 | Jaszewski et al. | |
| 10,287,963 | B2 | 5/2019 | Tsuno et al. | |
| 11,046,409 | B2 | 6/2021 | Wiegele et al. | |
| 11,066,140 | B1 * | 7/2021 | Huffer | B63H 20/18 |
| 11,183,739 | B2 | 11/2021 | Milroy et al. | |
| 11,781,701 | B2 | 10/2023 | Kimpara | |
| 11,820,479 | B2 | 11/2023 | Kimpara | |
| D1,018,424 | S * | 3/2024 | Norton | D12/317 |
| 2011/0244740 | A1 | 10/2011 | Daikoku et al. | |
| 2012/0064783 | A1 * | 3/2012 | Grez | B63H 20/14 440/6 |
| 2018/0362131 | A1 | 12/2018 | He et al. | |
| 2019/0118921 | A1 | 4/2019 | Drapeau | |
| 2019/0148700 | A1 | 5/2019 | Milroy et al. | |
| 2021/0143710 | A1 | 5/2021 | Sprague et al. | |
| 2022/0089261 | A1 * | 3/2022 | Bruestle | B63H 23/321 |
| 2023/0087983 | A1 | 3/2023 | Kimpara | |
| 2024/0270365 | A1 | 8/2024 | Podell | |

FOREIGN PATENT DOCUMENTS

| | | |
|---|---|---|
| JP | 2005153727 | 6/2005 |
| JP | 2005162054 | 6/2005 |
| JP | 2005162055 | 6/2005 |
| JP | 2013252736 | 12/2013 |

OTHER PUBLICATIONS

Extended European Search Report issued in Corresponding European Patent Application No. 23152371.3, dated Jul. 4, 2023.

Extended European Search Report issued in Corresponding European Patent Application No. 23208910.2, dated Apr. 23, 2024.

Extended European Search Report issued in European Patent Application No. 23152365.5, dated Jun. 26, 2023.

U.S. Appl. No. 17/469,479, "Propulsion Devices Having Electric Motors for Marine Vessels and Methods for Making the Same.".

U.S. Appl. No. 17/487,116, "Outboard Motor that ss Removable from Transom Clamp Bracket".

U.S. Appl. No. 17/509,739, "Integrated Copilot and Locking Mechanism for Marine Drives".

U.S. Appl. No. 17/550,463, "Marine Drive Lower Unit Having Extension Leg".

U.S. Appl. No. 17/554,540, "Outboard Motors Having Side and Rear Laydown Capability".

* cited by examiner 272
52
252
252
250
114
124
96
114
250
174
251B
270
176
170
182
251A
183
176
126
186
106
82
178
108
251B
110
218
106
218
184
270
172
250
251A
120
254
120
146
88
270
148
86
156
270
90
154
156
80
251B
254
174
256
251A
176
136
142
270
136

78
250
132
94

OUTBOARD MARINE DRIVES HAVING SUPPORTING FRAME AND COWLING

FIELD

The present disclosure relates to outboard marine drives for propelling a marine vessel in water.

BACKGROUND

The following U.S. Patents and Patent Applications are incorporated herein by reference in entirety:

U.S. Pat. No. 9,701,383 discloses a marine propulsion support system having a transom bracket, a swivel bracket, and a mounting bracket. A drive unit is connected to the mounting bracket by a plurality of vibration isolation mounts, which are configured to absorb loads on the drive unit that do not exceed a mount design threshold. A bump stop located between the swivel bracket and the drive unit limits deflection of the drive unit caused by loads that exceed the threshold. An outboard motor includes a transom bracket, a swivel bracket, a cradle, and a drive unit supported between first and second opposite arms of the cradle. First and second vibration isolation mounts connect the first and second cradle arms to the drive unit, respectively. An upper motion-limiting bump stop is located remotely from the vibration isolation mounts and between the swivel bracket and the drive unit.

U.S. Pat. No. 9,963,213 discloses a system for mounting an outboard motor propulsion unit to a marine vessel transom. The propulsion unit's midsection has an upper end supporting an engine system and a lower end carrying a gear housing. The mounting system includes a support cradle having a head section coupled to a transom bracket, an upper structural support section extending aftward from the head section and along opposite port and starboard sides of the midsection, and a lower structural support section suspended from the upper structural support section and situated on the port and starboard sides of the midsection. A pair of upper mounts couples the upper structural support section to the midsection proximate the engine system. A pair of lower mounts couples the lower structural support section to the midsection proximate the gear housing. At least one of the upper and lower structural support sections comprises an extrusion or a casting.

U.S. patent application Ser. No. 17/550,463 discloses a marine drive having a supporting frame for coupling the marine drive to a marine vessel, a gearcase supporting a propulsor for propelling the marine vessel in water, an extension leg disposed between the supporting frame and the gearcase, and an adapter plate between the supporting frame and the extension leg. A tube is in the extension leg. The tube has a lower end which is coupled to the gearcase and upper end which is coupled to the adapter plate by a compression nut threaded onto the tube, wherein threading the compression nut down on the tube compressively engages the compression nut with the adapter plate, which in turn clamps the extension leg between the supporting frame and the gearcase.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

In non-limiting examples disclosed herein, an outboard marine drive is configured for propelling a marine vessel in water. The outboard marine drive may include a propulsor configured to generate a thrust force in the water and a monolithic supporting frame which supports the outboard marine drive relative to the marine vessel. The monolithic supporting frame may extend from a front to a rear in a longitudinal direction, from a port side to a starboard side that is opposite the port side in a lateral direction which is perpendicular to the longitudinal direction, and from a top to a bottom in an axial direction which is perpendicular to the longitudinal direction and perpendicular to the lateral direction. The monolithic supporting frame may include a body, a support leg extending downwardly from the body and configured to support a propulsor housing for the propulsor, and a steering arm extending forwardly from the body for steering of the outboard marine drive. The support leg may be configured for attachment to the propulsor housing, and the steering arm may be configured for attachment to a transom bracket assembly for supporting the outboard marine drive on the marine vessel.

A power entry module may be coupled to the monolithic supporting frame, the power entry module being configured to regulate/control current and voltage for powering the propulsor. The power entry module may comprise a circuit board and at least one electrical connector. A module housing for the power entry module may be coupled to the body of the supporting frame. The cowling may be mounted on the module housing and the body of the monolithic supporting frame. The cowling may be suspended on the module housing and the body of the monolithic supporting frame. The cowling may enclose the power entry module on the rear of the monolithic supporting frame. The monolithic supporting frame may define a passage for an electrical connector extending from the propulsor housing to the power entry module. The passage may comprise a throughbore axially extending through the support leg to a cavity in the monolithic supporting frame. The module housing may comprise a window through which the electrical connector extends from the propulsor housing to the power entry module, via the passage in the monolithic supporting frame.

In non-limiting examples, a cowling may be on the body of the monolithic supporting frame, the cowling comprising a lid which is movable into and between a closed position enclosing the body and an open position providing access to the body. A service tray may be removably coupled to the top of the monolithic supporting frame, wherein the lid in the open position provides service access to the service tray. A fuse may be coupled to the service tray, wherein the lid in the open position provides service access to the fuse. An electronic service tool connector may be coupled to the service tray, wherein the lid in the open position provides service access to the electronic service tool connector. A weather cap may be coupled to the service tray, wherein the lid in the open position provides service access to the weather cap, for removal and mounting on an electrical connector port for providing power to the propulsor. The service tray may be configured for coupling to and decoupling from the monolithic supporting frame without use of tools. The service tray may be removable from the body through the lid in the open position.

BRIEF DESCRIPTION OF THE DRAWINGS

The present disclosure includes the following Figures.

DETAILED DESCRIPTION

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus <10% of the particular term and "substantially" and "significantly" will mean plus or minus >10% of the particular term.

Figure 1:
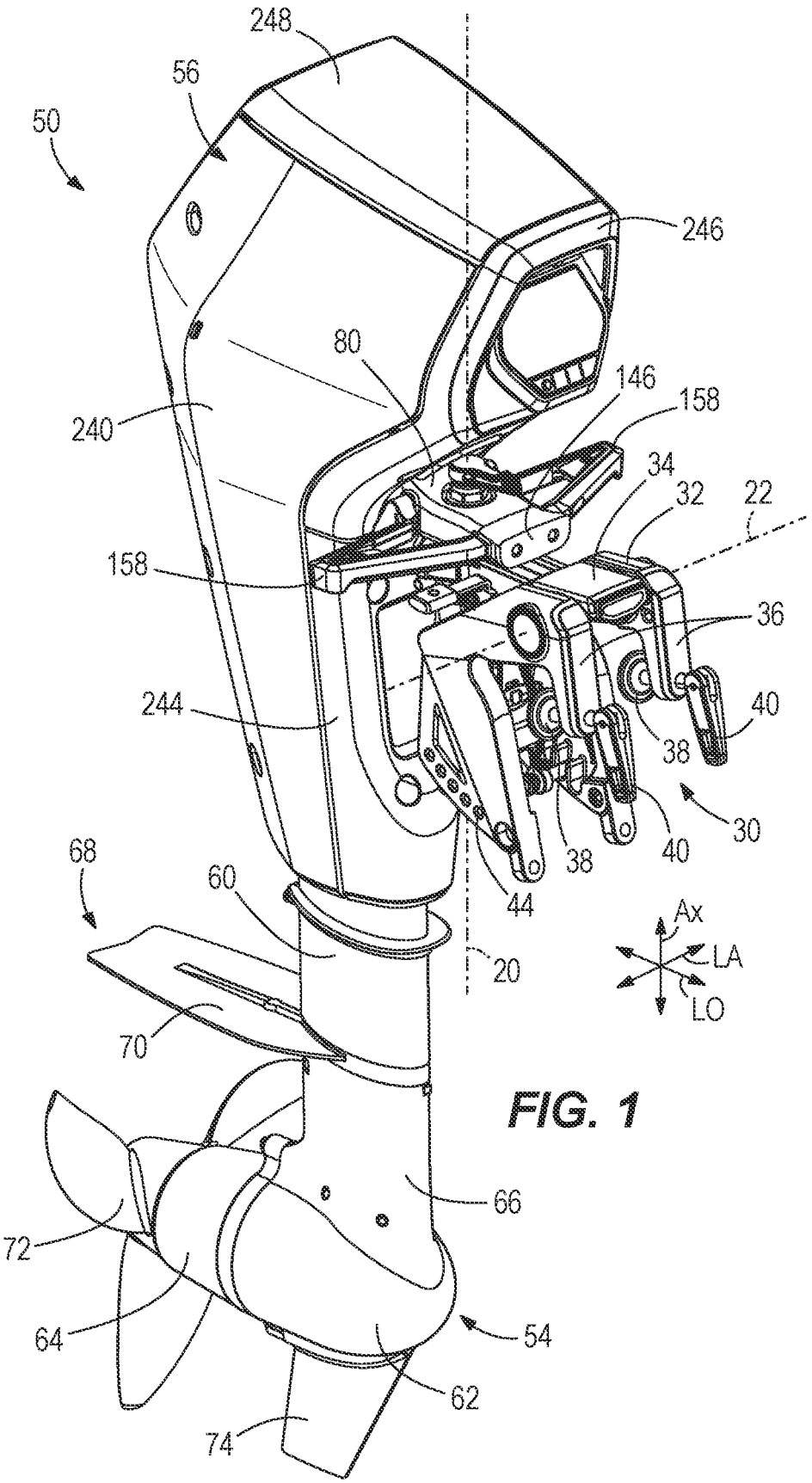
FIG. 1 is a perspective view of an outboard marine drive that is supported on a transom bracket assembly and includes a cowling suspended from a supporting frame and a power entry module.
Figure 2:
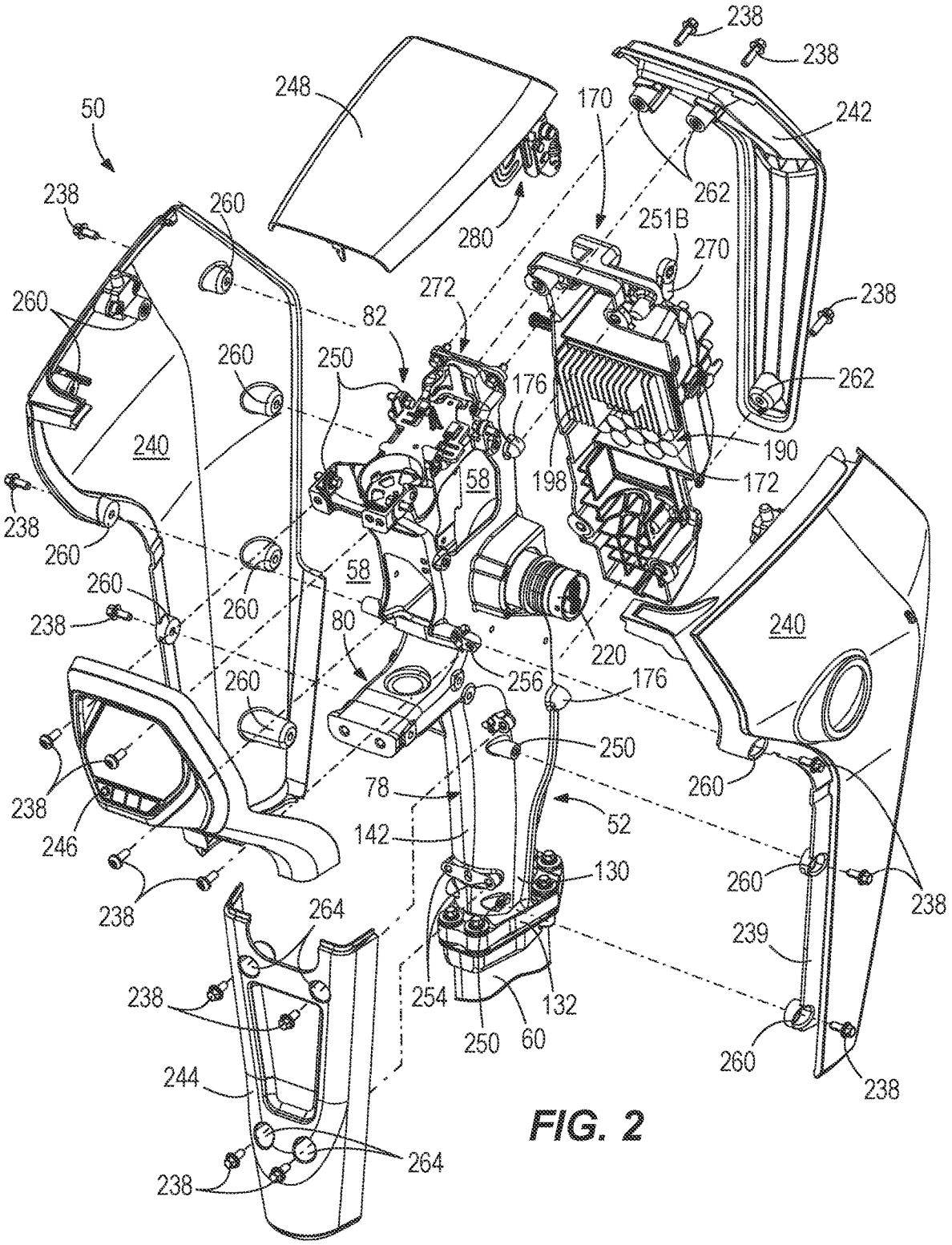
FIG. 2 is an exploded perspective view of the marine drive of FIG. 1.

FIGS. 1 and 2 depict a marine drive 50 for propelling a marine vessel in a body of water. In the illustrated embodiment, the marine drive 50 extends from top to bottom in an axial direction AX, from front to back in a longitudinal direction LO which is perpendicular to the axial direction AX, and from side to opposite side in a lateral direction LA which is perpendicular to the axial direction AX and perpendicular to the longitudinal direction LO. A transom bracket assembly 30 supports the marine drive 50 on the transom (not shown) of the marine vessel such that the marine drive 50 is trimmable up and down relative to the transom bracket assembly 30, including in non-limiting examples wherein the marine drive 50 is raised completely out of the water.

The marine drive 50 includes a supporting frame 52 for rigidly supporting the various components of the marine drive 50 with respect to the marine vessel and a propulsor housing 54 secured to the supporting frame 52. A cowling 56 is fixed to and surrounds most or all of the supporting frame 52. The cowling 56 includes a plurality of cowling panels 240-248 and defines a cowling interior 58 in which a portion of the supporting frame 52 is enclosed and various components of the marine drive 50 are disposed. The marine drive 50 includes an extension leg 60 which is coupled to the supporting frame 52 and extends downwardly to the propulsor housing 54. The propulsor housing 54 has a front housing portion 62 and a rear housing portion 64 which are mated together and define a watertight lower housing cavity for containing a motor (not shown) and related componentry. The front housing portion 62 has a nosecone with a smooth outer surface which transitions to an upwardly extending stem 66 and a downwardly extending skeg 74. An anti-ventilation plate 68 is positioned between the extension leg 60 and the stem 66 and includes an anti-cavitation plate 70 that extends rearwardly from the extension leg 60. A conventional propulsor 72 is mounted on the outer end of a propulsor shaft extending from the propulsor housing 54 such that rotation of the propulsor shaft by the motor causes rotation of the propulsor 72, which in turn generates a thrust force for propelling the marine vessel in water. It should be understood that the various components described above are exemplary and could vary from what is shown.

With continued reference to FIGS. 1 and 2, the marine drive 50 is coupled to the transom (not shown) of a marine vessel by a transom bracket assembly 30, which in the illustrated example includes a transom bracket 32 configured to be fixed to the transom and a swivel bracket 34 pivotably coupled to the transom bracket 32. The transom bracket 32 has a pair of C-shaped arms 36 which fit over the top of the transom and a pair of threaded, plunger-style clamps 38 which clamp the C-shaped arms 36 to the transom. Rotation of handles 40 in one direction clamps the transom between the C-shaped arms 36 and plunger-style clamps 38. Rotation of the handles 40 in the opposite direction frees the C-shaped arms 36 for removal from the transom. In some embodiments, the transom bracket 32 is additionally or alternatively fixed to the transom by at least one fastener (not shown).

The swivel bracket 34 is pivotable with respect to the C-shaped arms 36 about a pivot shaft that laterally extends through the forward upper ends of the C-shaped arms 36, thereby defining a trim axis 22. Pivoting of the swivel bracket 34 about the pivot shaft trims the marine drive 50 relative to the marine vessel, for example out of and/or back into the body of water in which the marine vessel is operated. A selector bracket 44 having holes is provided on at least one of the C-shaped arms 36. Holes respectively become aligned with a corresponding mounting hole on the swivel bracket 34 at different selectable trim positions for the marine drive 50. A selector pin (not shown) can be manually inserted into the aligned holes to thereby lock the marine drive 50 in place with respect to the trim axis 22.

The marine drive 50 is supported on the swivel bracket 34 by a steering arm 80, which extends from the body 82 of the supporting frame 52 of the marine drive 50, generally along the midsection of the marine drive 50. A swivel tube assembly (not shown) extends transversely from the steering arm 80 and is removably received in a swivel cylinder (not shown) of the swivel bracket 34. The marine drive 50 can be steered left or right relative to the marine vessel by rotating about the steering axis 20, which is defined by the swivel tube and swivel cylinder, via a manually operable tiller (not shown) and/or any other known apparatus for steering a marine drive with respect to a marine vessel.

Figure 3:
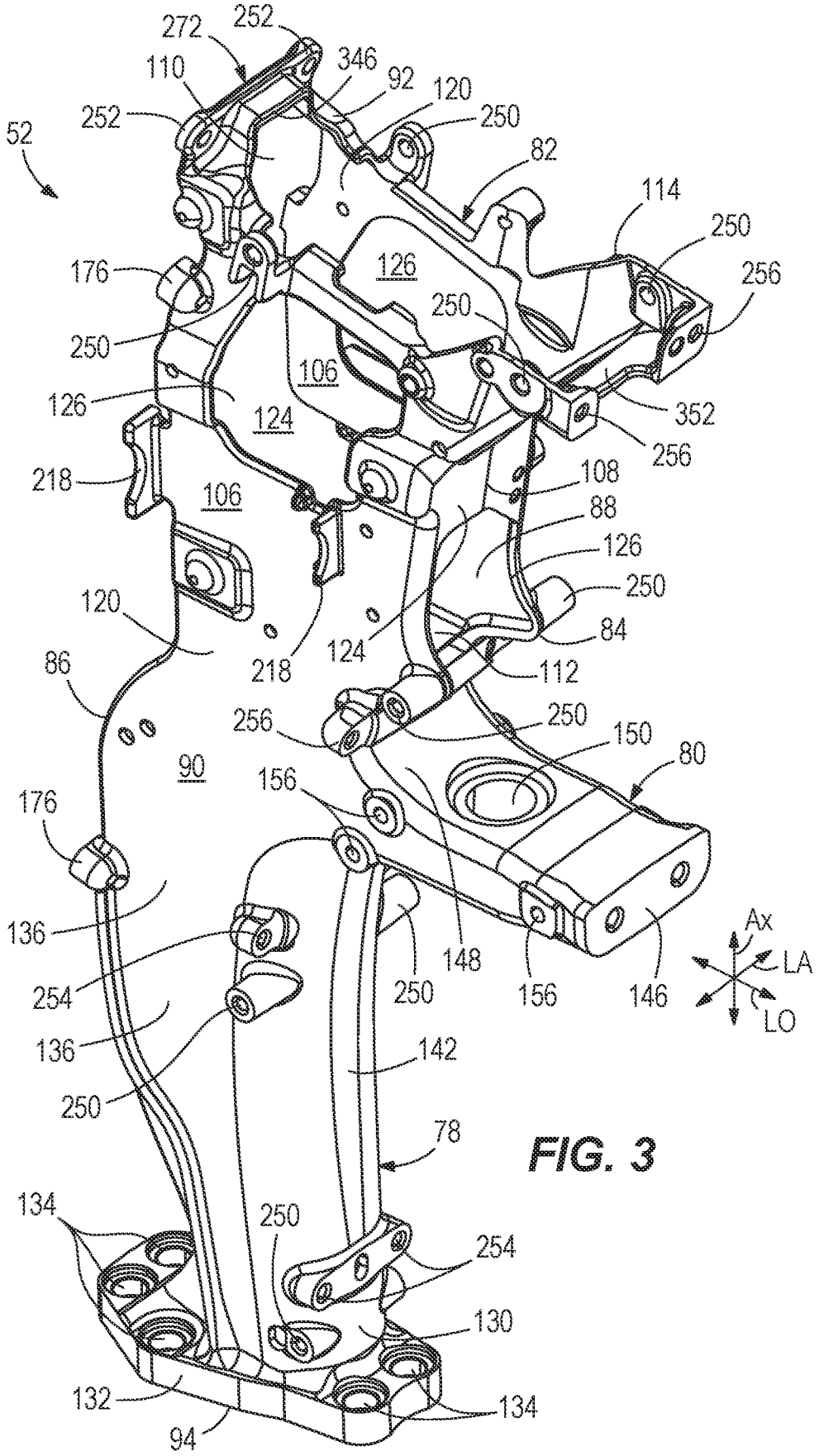
FIG. 3 is a front-side-top perspective view of the supporting frame from the marine drive of FIG. 2.
Figure 4:
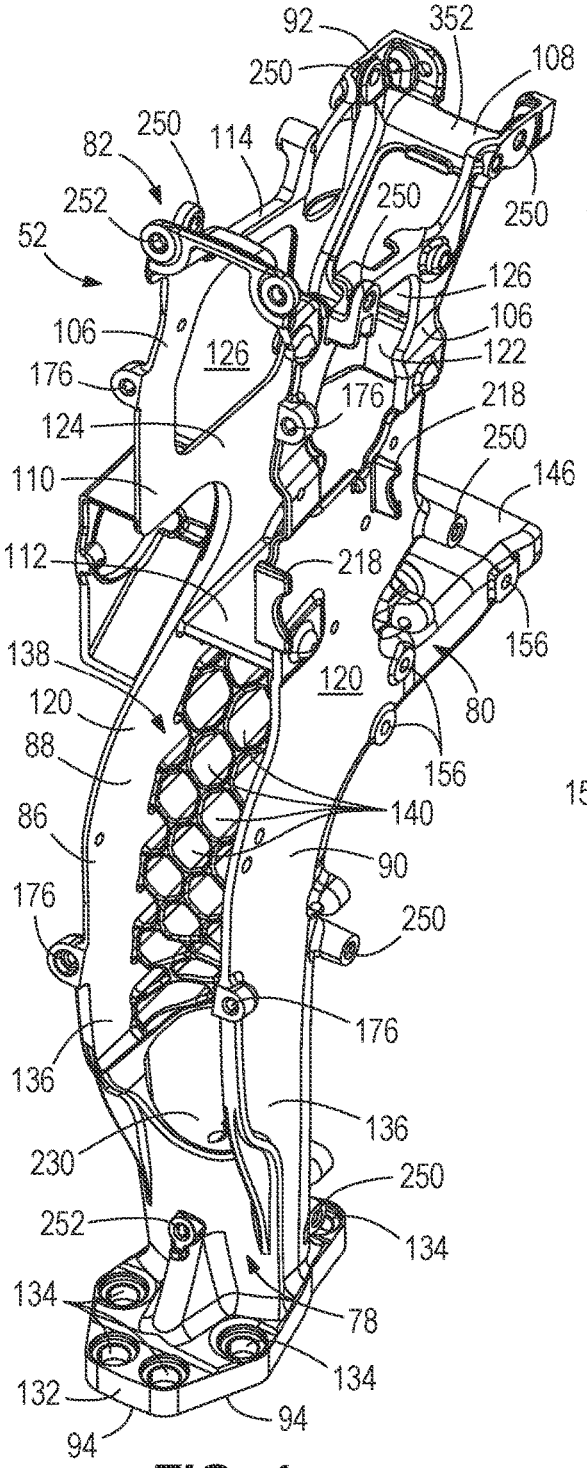
FIG. 4 is a rear-side-top perspective view of the supporting frame of FIG. 3.
Figure 5:
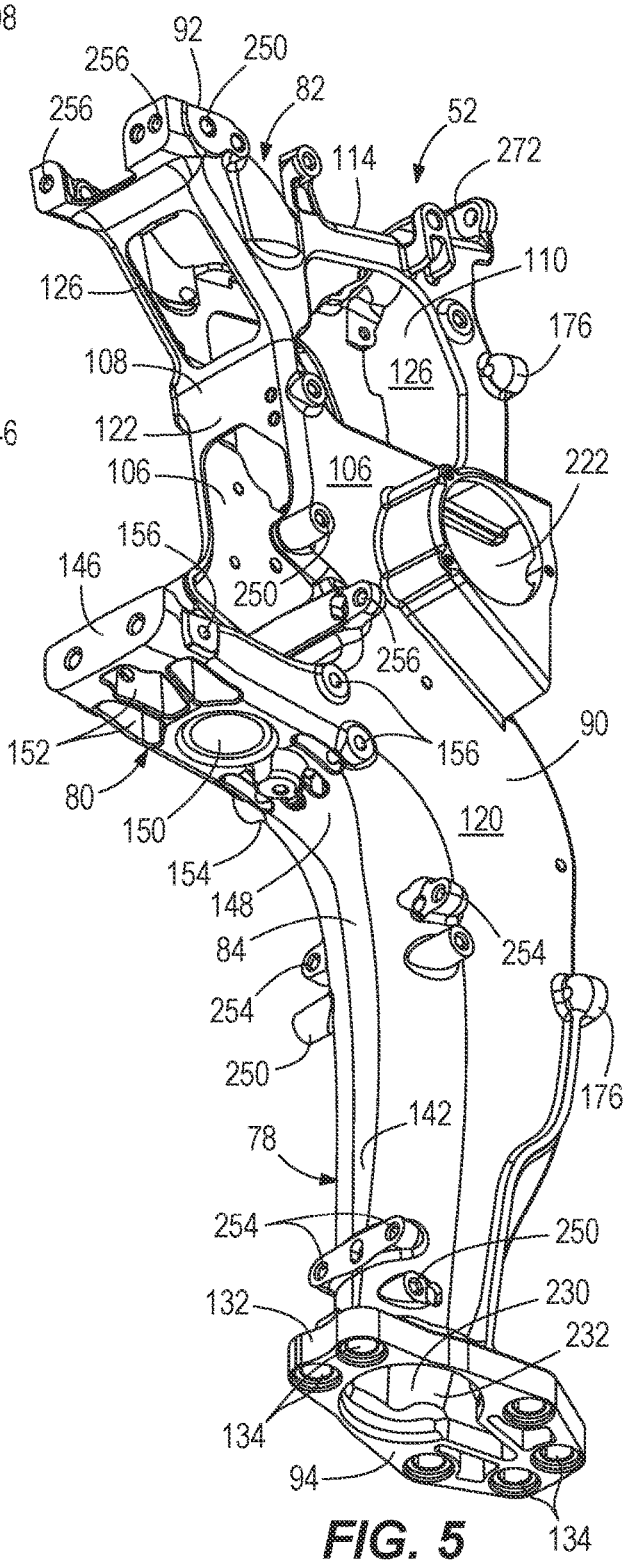
FIG. 5 is a front-side-bottom perspective view of the supporting frame of FIG. 4.
Figure 6:
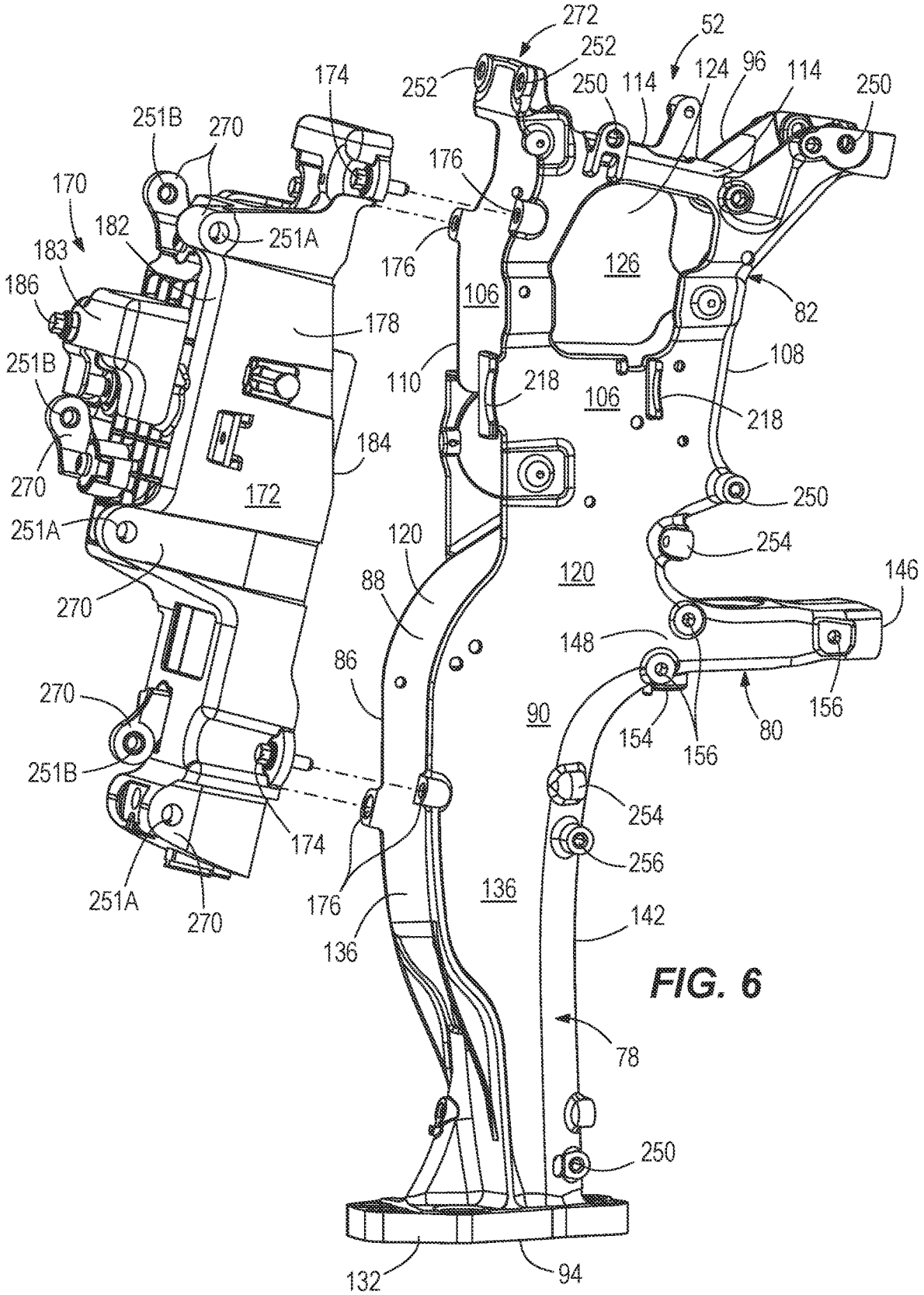
FIG. 6 is an exploded perspective view of the supporting frame and power entry module of FIG. 2.

Referring to FIGS. 3-5, the supporting frame 52 extends from a front side 84 to a rear side 86 in a longitudinal direction, from a port side 88 to a starboard side 90 that is opposite the port side 88 in a lateral direction which is perpendicular to the longitudinal direction, and from a top end 92 to a bottom end 94 in an axial direction which is perpendicular to the longitudinal direction and perpendicular to the lateral direction.

The supporting frame 52 includes a body 82 and a support leg 78 that extend downwardly from the body and are configured to support the extension leg 60 and the propulsor housing 54. The body 82, which is at the top end 92 of supporting frame 52, includes port and starboard sides 106, a front side 108, an open rear side 110, a bottom end 112, and an upper end 114. The port and starboard sides 106 are formed by opposing side walls 120 spaced laterally apart from each other, and a front wall 122 extending between the opposing side walls 120 forms the front side 108 of the body 82. A cavity 124 is defined between the opposing side walls 120 and is configured to house electrical connectors, electronics, and/or any other components of the marine drive 50. For example, a control module containing hardware and software for controlling operational performance of the marine drive 50 may be mounted inside the supporting frame 52, for example along the sidewall 120 in the cavity 124. The opposing sidewalls 120 of the supporting frame 52 thus advantageously provide the ability to layer and efficiently package sensitive electrical components within the cavity 124, in a rigid (box-type) protective structure. Access cutouts 126 formed in the side walls 120 and the front wall 122 and the open rear side 110 and upper end 114 provide access into the cavity 124 and the components therein.

The support leg 78 extends downwardly from the bottom end 112 of the body 82 and has a lower end 130 with a frame mounting flange 132 that extends from and around the perimeter of the support leg 78 at a bottom end thereof. A plurality of bores 134 are formed through the frame mounting flange 132, and each bore 133 in the frame mounting flange 132 is arranged in vertical axial alignment with a corresponding bore formed through a leg mounting flange at the upper end of the extension leg 60. The opposing side walls 120 extend downwardly from the body 82 and form the lateral sides 136 of the support leg 78. A honeycomb structure 138 is formed between the opposing side walls 120 along the axial length of the support leg 78. The honeycomb structure 138 is formed by a plurality of cavities 140 which extend longitudinally from the front side 142 of the support leg 78 towards the rear side 86. Advantageously, the honeycomb structure 138 may provide strength and rigidity to the support leg 78 without adding a significant amount of weight or requiring the additional material that would be needed for a solid structure. Through research and experimentation, the present inventors determined that hexagonal cavities 140 provide an advantageous balance between strength, weight, and ease of manufacture. Some embodiments, however, may include a honeycomb structure with at least one differently shaped cavity, or the honeycomb structure may be omitted.

With continued reference to FIGS. 3-5, the supporting frame 52 has a steering arm 80 extending forwardly from the front side 108 of the body 82. As previously mentioned, the steering arm 80 is configured for connection to a tiller arm 28 for manually steering the marine drive 10 relative to the marine vessel 50. The steering arm 80 extends forwardly from the body 82 towards the transom of the marine vessel. A first end 146 of the steering arm 80 is configured to be connected to the tiller and an opposite, second end 148 is connected to the front side 108 of the body 82 and/or the front side 142 of the support leg 78. A through-bore 150 is formed through the steering arm 80 from a top to bottom and is configured to receive the steering tube assembly for attaching the steering arm 80 to the swivel bracket 34 of the transom bracket assembly 30. As illustrated in FIG. 5, at least one cavity 152 may be formed in the upper surface, lower surface and/or a side surface of the steering arm 80. This may be useful, for example, to reduce weight without compromising the strength of the steering arm 80. Holes 156 formed in the lateral sides of the steering arm 80 are configured to receive fasteners for securing support wings 158 (see FIG. 1) to opposite lateral sides of the steering arm 80. The steering arm 80 may additionally include a steering stop 154 projecting downwardly from the steering arm 80 proximate the through-bore 150. When the marine drive 50 is installed on the transom bracket assembly 30, the steering stop 154 is configured to abut a portion of the swivel bracket 34 to delineate a steering range for the marine drive 50.

In the illustrated embodiments, the supporting frame 52 is a monolithic structure with the body 82, the steering arm 80, and the support leg 78 formed as a single, unitary component. some embodiments, however, may include a multi-part supporting frame with at least one of body, the steering arm, and the support leg configured as a separate component that is secured to the supporting frame and/or any other part of the marine drive.

As previously mentioned, the supporting frame 52 is configured to support a plurality of electrical components for operating the marine drive 50. Ample mounting space is provided by the opposing side walls, which are configured to support components on an interior or exterior surface of each side wall 120. One such component is the power entry module (PEM) 170, which is coupled to the rear side 86 of the supporting frame 52. The PEM 170 is configured for regulate/control the current and voltage supplied to the marine drive 50 to power the propulsor 72 and/or other components of the marine drive 50. Referring to FIGS. 6-9, the PEM 170 includes a housing 172 that is coupled to the body 82 and the support leg 78 by fasteners 174. Each fastener 174 engages a mounting opening 176 on the PEM 170 and a corresponding mounting opening 176 on the supporting frame 52. In the illustrated embodiments, the opposing side walls 120 of the supporting frame 52 each include two rear-facing mounting openings 176—one on the rear side 110 of the body 82 and one on the rear side of the support leg 78—for mounting the PEM 170 on the supporting frame 52. Some embodiments, however, may include a different number of mounting openings 176 and/or at least one mounting opening 176 may be positioned differently than those of the illustrated embodiments.

Figure 9:
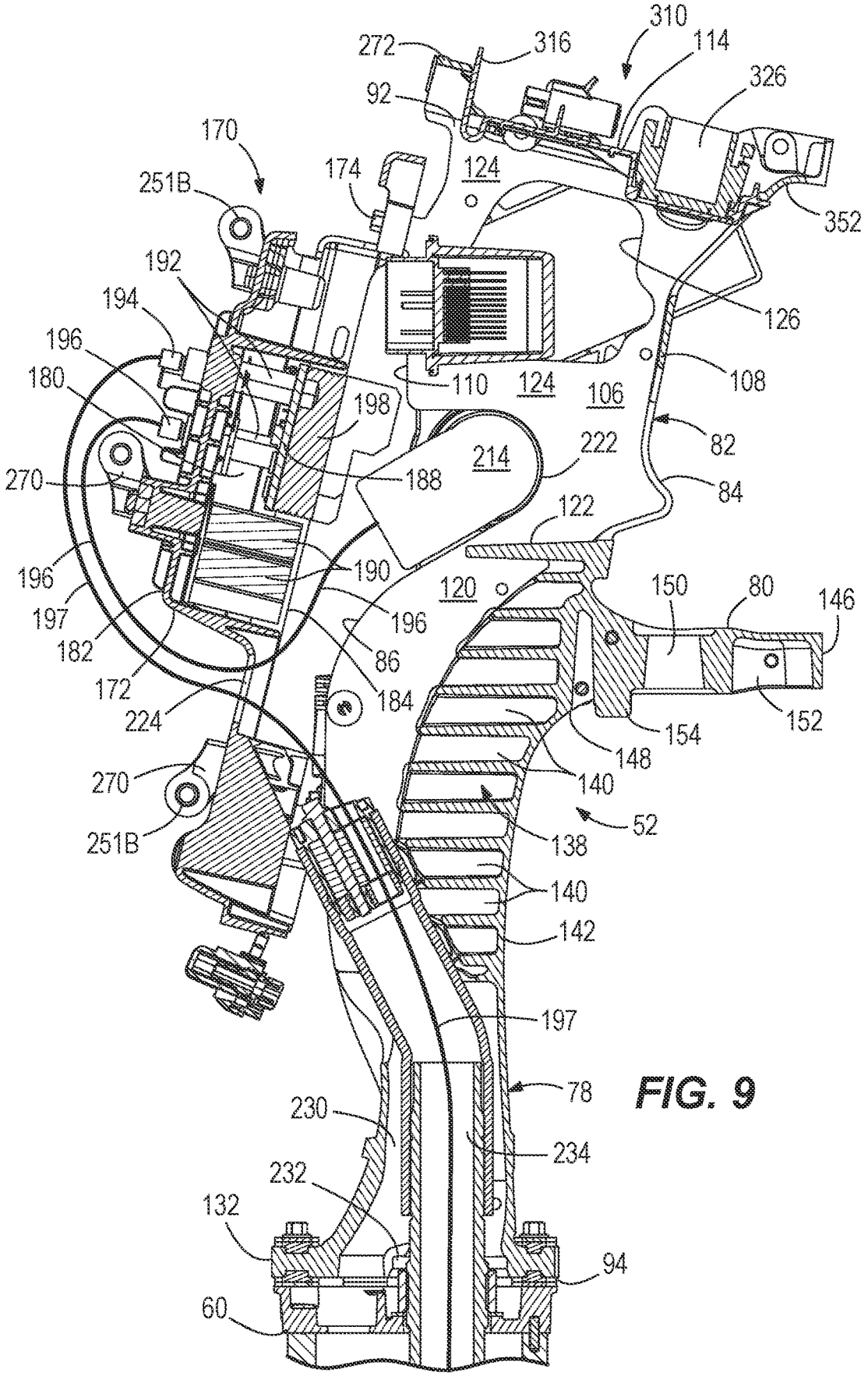
FIG. 9 is a view of section 9-9 taken in FIG. 8.

The housing 172 of the PEM 170 includes a generally rectangular body 178 which defines an interior cavity 180 and includes a rear wall 182 and a front side 184 which may be open and exposed to the cavity 124 of the supporting frame 52. As best illustrated in FIG. 9, a circuit board 188 and at least one capacitor 190 are supported within the interior cavity 180 housing 172. Electrical connectors 192, 194 are connected to the circuit board 188 and extend through the rear wall 182, and a heat sink 198 is secured to the opposite side of the circuit board 188. The illustrated embodiment includes two electrical connectors 192 configured to be connected to the motor and two electrical connectors 194 configured to be connected to a power source. The ends of the electrical connectors 192, 194 are configured to be connected to corresponding electrical connectors 196, 197 on the PEM 70. A cover 183 is removably secured to the housing 172 by a fastener 186 and is configured to cover the otherwise exposed ends of the electrical connectors 196, 197. In some embodiments, empty space within the interior cavity 180 of the PEM 170 may be filled with a potting material. Other embodiments, however, may omit the potting material.

In some embodiments, the circuit board 188 may be configured as a control board with a processing system and a storage system. The processing system includes one or more processors, which may each be a microprocessor, a general-purpose central processing unit, an application-specific processor, a microcontroller, or any other type of logic-based device. The processing system may also include circuitry that retrieves and executes software from the storage system. The processing system may be implemented with a single processing device but may also be distributed across multiple processing devices or subsystems that cooperate in executing program instructions. The storage system can comprise any storage media, or group of storage media, readable by the processing system, and capable of storing software. The storage system may include volatile and non-volatile, removable and non-removable media implemented in any method or technology for storing information, such as computer-readable instructions, program modules comprising such instructions, data structures, etc. The storage system may be implemented as a single storage device but may also be implemented across multiple storage devices or subsystems. Examples of storage media include random access memory, read only memory, optical discs, flash memory, virtual memory, and non-virtual memory, or any other medium which can be used to store the desired information and that may be accessed by an instruction execution system, as well as any combination of variation thereof. The storage media may be housed locally with the processing system, or may be distributed, such as distributed on one or more network servers, such as in cloud computing applications and systems. In some implementations, the storage media is non-transitory storage media. In some implementations, at least a portion of the storage media may be transitory.

Figure 7:
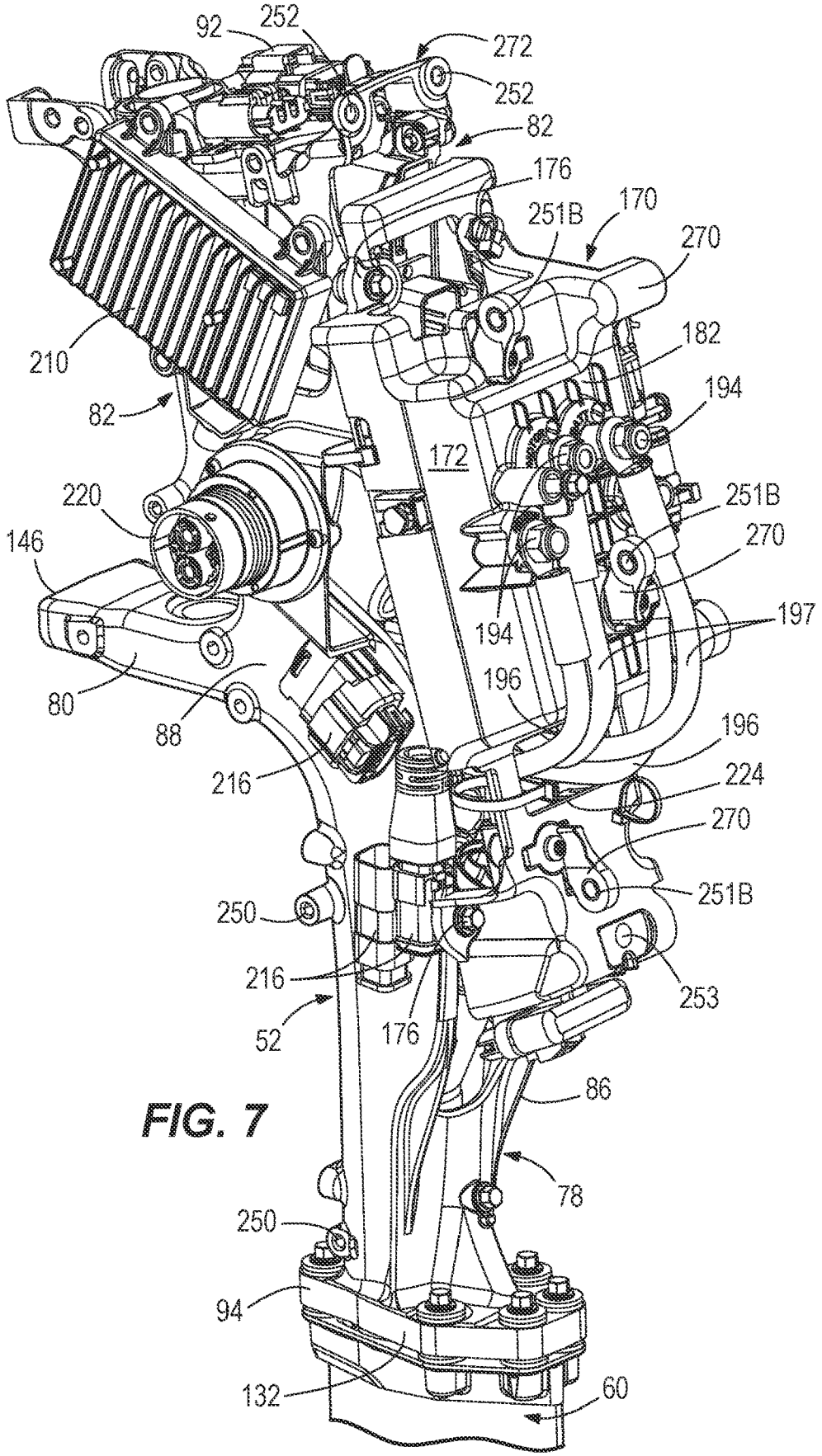
FIG. 7 is a rear-side-top perspective view of the supporting frame and power entry module of FIG. 6 with additional componentry.
Figure 8:
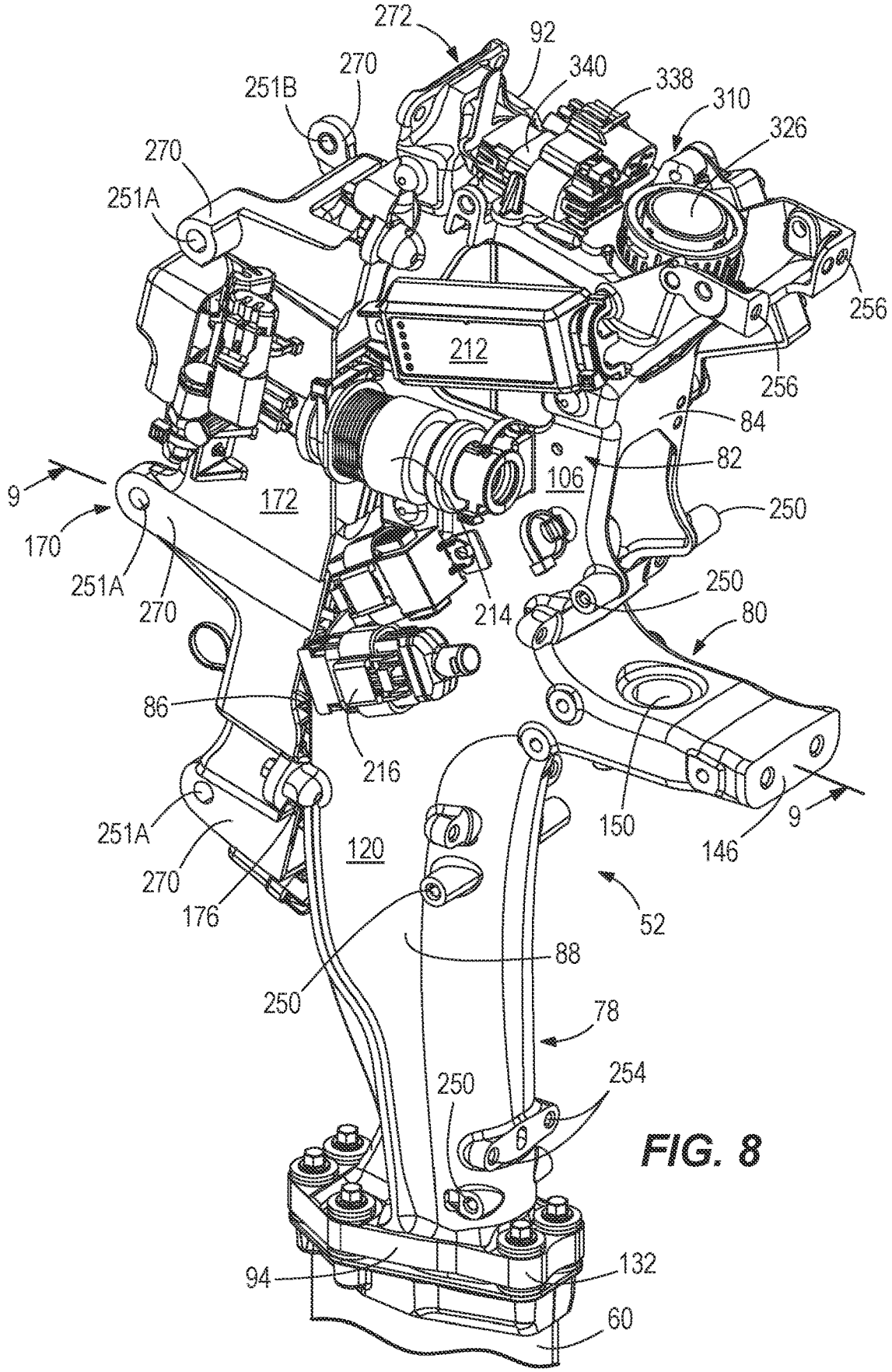
FIG. 8 is a front-side-top view of the supporting frame and power entry module of FIG. 7.

With continued reference to FIGS. 6-9, at least one additional component may be mounted on the supporting frame 52. For example, as illustrated in FIG. 7, the marine drive 50 may include a power converter 210 secured to at least one mounting opening formed in the port side wall 120 of the body 82 of the supporting frame 52. The illustrated power converter 210 is a DC-to-DC converter optionally having multiple outlets that steps the voltage down (e.g., 48V to 12V) for powering sensors and/or other electrical components of the marine drive 50. As illustrated in FIG. 8, a connectivity module 212 may be secured to the starboard side wall 120 proximate the upper end 114 of the body 82. The connectivity module 212 is configured to allow the marine drive 50 to communicate wirelessly with other devices on the marine vessel and/or another user device via Bluetooth, Wi-Fi and/or another wireless communication protocol. This may be useful, for example, in order to remotely control the marine drive 50. A connector port 214 for connecting the marine drive 50 to a remotely operated steering system (not shown) is coupled to the side wall 120 below the connectivity module 212 and is supported by support brackets 218 (see FIG. 3) projecting outward from the side wall 120. Additionally or alternatively, at least one electrical connector 216, wire support/guide 218, and/or other component may be secured to a corresponding mounting opening formed in the port or starboard side wall 120, the front wall 122, or any other part of the supporting frame 52.

Referring to FIGS. 7 and 9, power is supplied to the marine drive 50 via an electrical connector port 220 positioned on the starboard side 90 of the supporting frame 52. The electrical connector port 220 is mounted in a port opening 222 (see FIG. 5) which is formed through the starboard side wall 120 and opens into the cavity 124 in the body 82 of the supporting frame 52. Electrical connector cables 196 extend from the electrical connector port 220, through the cavity the cavity 124 in the body 82, out a window 224 formed in the housing 172 of the PEM 170, and up to a corresponding pair of the electrical connectors 192. The PEM 170 is similarly connected to the propulsor 72 (i.e., the motor) in the propulsor housing 54 by electrical connectors 197 which extend through the supporting frame 52. The supporting frame 52 defines a passage 230 for an electrical connector 196 extending from the propulsor housing 54 to the PEM 170. As illustrated in FIGS. 5 and 9, the passage 230 includes a through-bore 232 that extends axially through the support leg 78 to the cavity 124 in the body 82 and/or the support leg 78 of the supporting frame 52. A conduit 234 extends through the passage 230 and extension leg 60 from a lower end (not shown) in the propulsor housing 54 to an upper end 236 in the cavity 124. The corresponding electrical connectors 197 extend from the propulsor housing 54, through the conduit 234 and the passage 230, out the window 224 in the housing 172 of the PEM 170, and up to the corresponding pair of the electrical connectors 194. Some embodiments, however, may be configured with a different rigging arrangement.

As previously mentioned, the marine drive 50 includes a cowling 56 with a plurality of cowling panels 240-248 coupled to and suspended from both the supporting frame 52 and the housing 172 of the PEM 170. The cowling 56 encloses the body 82 of the supporting frame 52 and the PEM 170 on the rear side 86 of the supporting frame 52. Referring to FIGS. 2 and 10-12, the cowling includes starboard and port side panels 240, a rear panel 242, a lower front panel 244, an upper front panel 246, and a lid 248, which is movable into and between an open and closed position. The port and starboard side panels 240 are each secured to a corresponding set of mounting openings 250 formed in the port and starboard sides 88, 90 of the supporting frame 52 and/or the PEM housing 172 with fasteners 238. Each side 88, 90 of the supporting frame 52 includes two mounting openings 250 formed along the front side 142 of the support leg 78. Three mounting openings 250 are formed in the body 82, including two openings 250 formed in the side walls 120 along the upper end 114 of the body and one opening 250 formed in the side walls 120 proximate the front side 108 of the body 82. The five mounting openings 250 for the side panels 240 formed in the supporting frame 52 each correspond to an opening 260 formed in the side panels 240. The illustrated side panels 240, for example include three openings 260 formed in a lip 239 that extends along a front edge of the side panels 240 and two openings 260 formed along a top edge of the side panels 240.

The PEM housing 172 also includes mounting openings 251A, 251B for securing the side panels 240 thereto. In the illustrated embodiments, for example, the housing 172 of the PEM 170 includes three mounting openings 251A for the starboard panel 240 spaced along the starboard side of the PEM housing 172 and three mounting openings 251B for the port panel 240 spaced along the port side of the PEM housing 172. Each mounting opening 251A, 251B is formed through a mounting bracket 270 arranged on the body 178 of the PEM housing 172. Unlike the mounting openings 260 formed in the supporting frame 52, the mounting openings 251A, 251B formed in the PEM housing 172 are not arranged symmetrically. That is, the mounting openings 251A spaced along the starboard side of the PEM housing 172 are not aligned with the mounting openings 251B spaced along the port side of the PEM housing 172. The port and starboard side panels 240 each include a corresponding set of mounting openings 260 configured for securing the side panels 240 to the mounting openings 251A, 251B arranged on the PEM housing 172.

Figure 11:
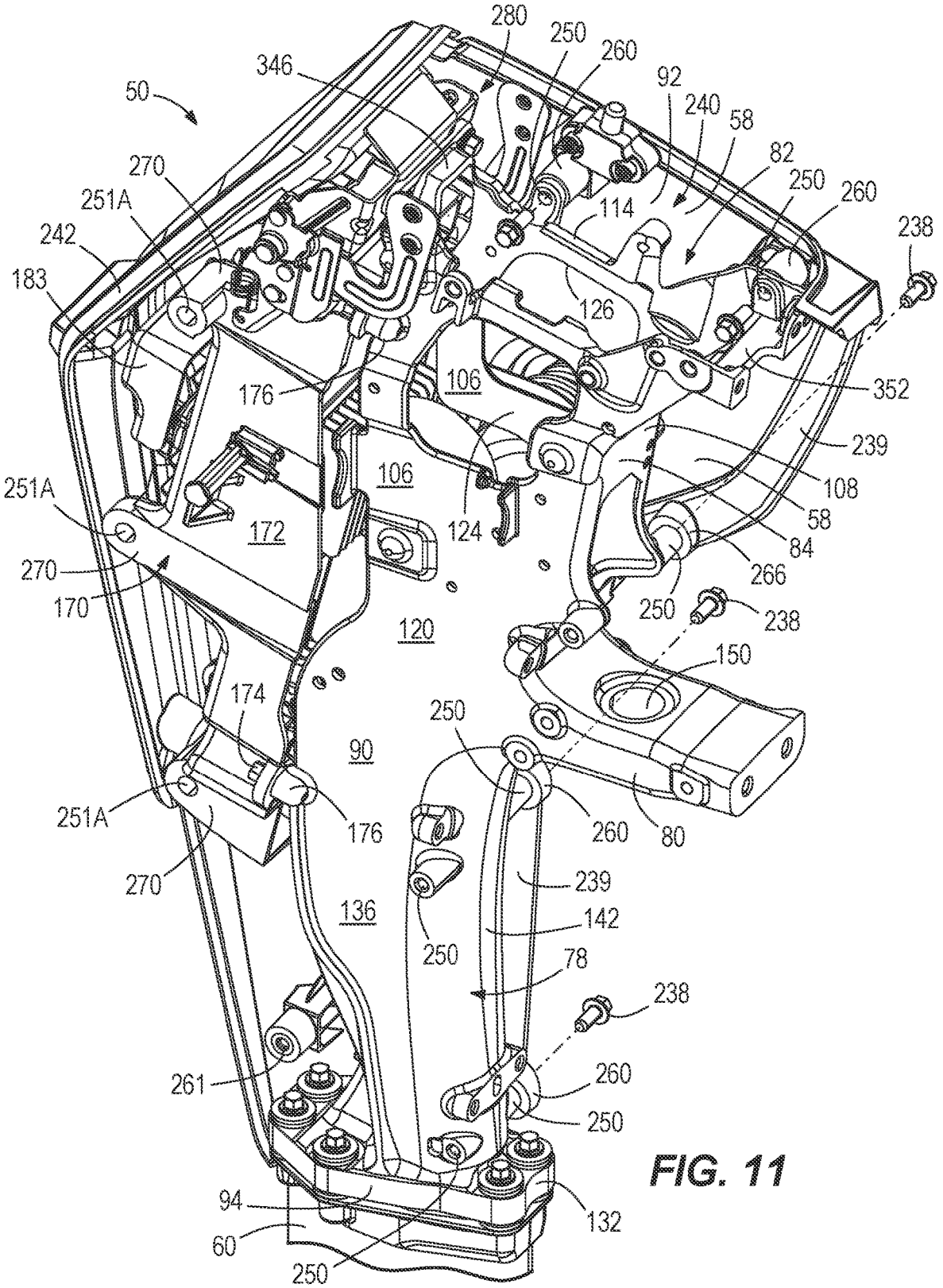
FIG. 11 is a detailed perspective view of the supporting frame and power entry module of FIG. 10 with a port side cowling panel.

Additionally or alternatively, the port and starboard side panels 240 may be coupled to each other. As illustrated in FIGS. 2 and 11, the side panels 240 each include a mounting opening 261 formed in an inwardly extending protrusion proximate the rear side 86 and the bottom end 94 of the support leg 78. The panel mounting openings 261 are configured to be aligned with each other so that the port side panel 240 can be coupled to the starboard side panel 240 with a fastener 238.

Figure 12:
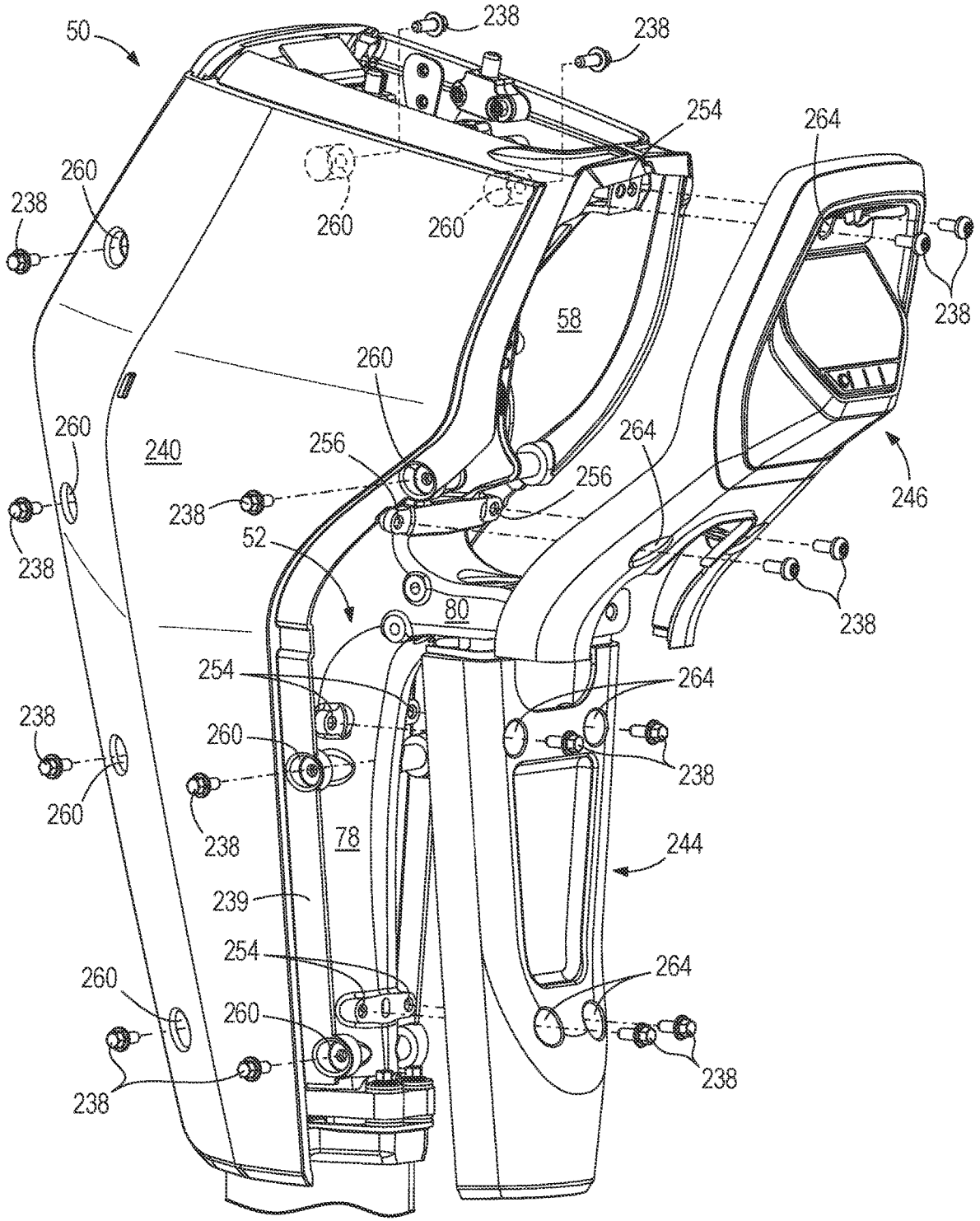
FIG. 12 is a detailed perspective view of the supporting frame and power entry module of FIG. 11 with a starboard side cowling panel showing two front cowling panels in exploded view.

Referring to FIGS. 2 and 12, the upper and lower front panels 244, 246 are each suspended from the supporting frame 52. The lower front panel 244 includes four mounting openings 264 that each correspond to a mounting opening 254 formed along the lateral sides of the front side 142 of the support leg 78. Similarly, the upper front panel 246 includes four mounting openings 266 that each correspond to a mounting opening 256 formed along the lateral sides of the front side 84 of the body 82 of the supporting frame 52.

Figure 10:
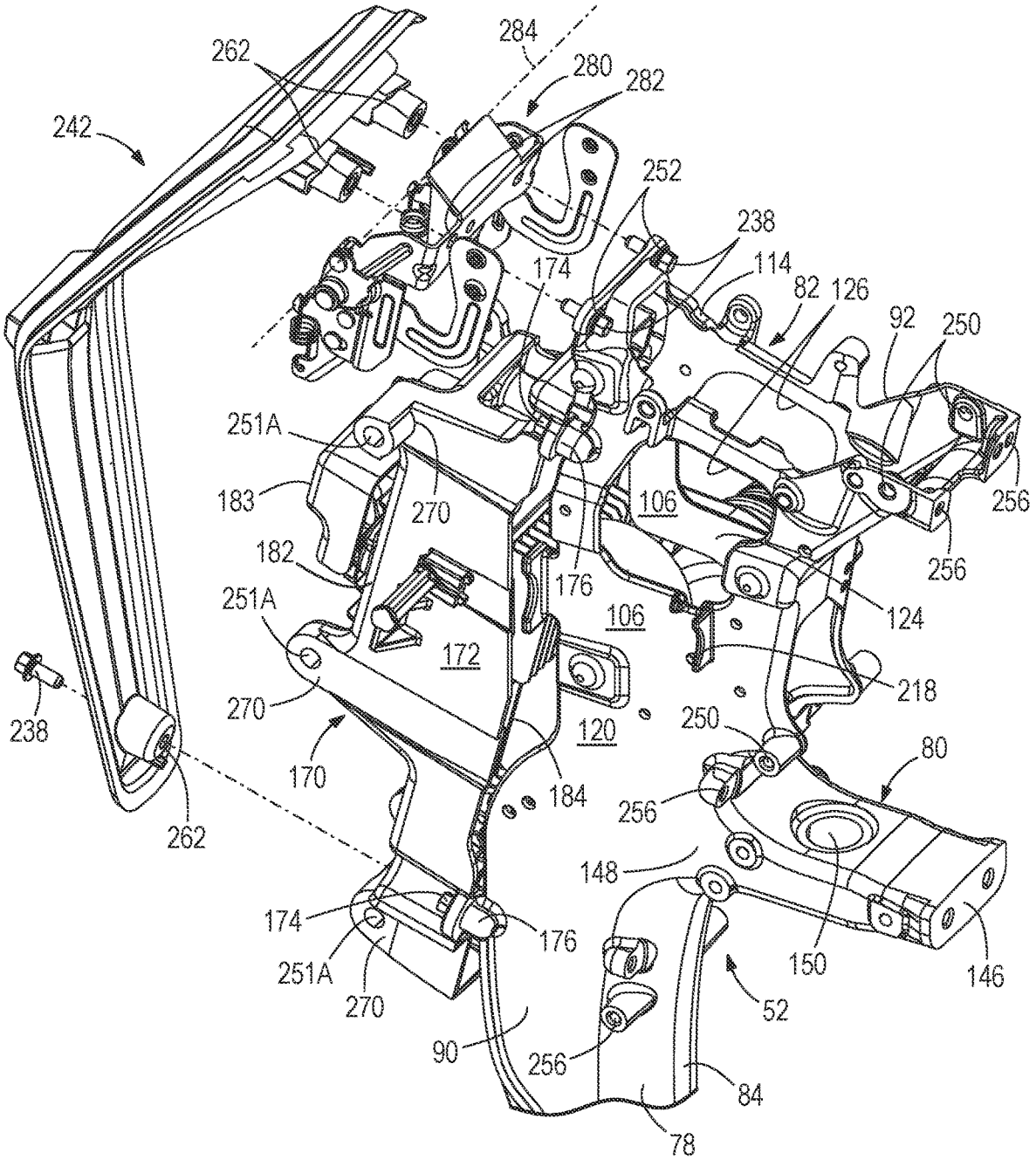
FIG. 10 is a detailed perspective view of the supporting frame and power entry module of FIG. 9 with an exploded view of a rear cowling panel and a hinge assembly.

Referring to FIGS. 2 and 10, the rear panel 242 of the cowling 56 is suspended from the supporting frame 52 and the housing 172 of the PEM 170. The supporting frame 52 includes a mounting bracket 272 that extends upwardly from the top end 92 of the body 82 proximate a rear side 86 thereof. The mounting bracket 272 includes two upper mounting openings 252 which correspond to mounting openings 262 formed in the rear panel 242, as well as mounting openings 282 in a hinge assembly 280 for the lid 248. Fasteners 238 extend through the mounting openings 252 in the mounting bracket 272 and the openings 282 in the hinge assembly 280 to couple the rear panel 242 to the mounting bracket, sandwiching the hinge assembly 280 therebetween. The rear panel 242 also includes a third mounting opening 262 positioned proximate a lower end of the rear panel 242. The third mounting opening 262 corresponds to a mounting opening 253 formed in the rear side of the PEM housing (see FIG. 7) and is configured to be secured thereto with a fastener 238. A lower mounting opening 252 is for coupling of a ground strap to the supporting frame 52 to prevent corrosion thereof. The ground strap and its functionality is further described in co-pending U.S. patent application Ser. No. 17/891,966, which is incorporated herein by reference in entirety.

The lid 248 of the cowling 56 is coupled to the hinge assembly 280, which allows the lid 248 to pivot about a pivot axis 284 defined by the hinge assembly 280 between an open position and a closed position. When the lid 248 is in the closed position, the body 82 of the supporting frame 52 is enclosed within the cowling 56. When the lid 248 is moved into an open position, the body 82 is accessible through an opening 286 in the top of the cowling 56. This may be useful, for example in order to service componentry within the body 82 of the supporting frame 52.

Figure 13:
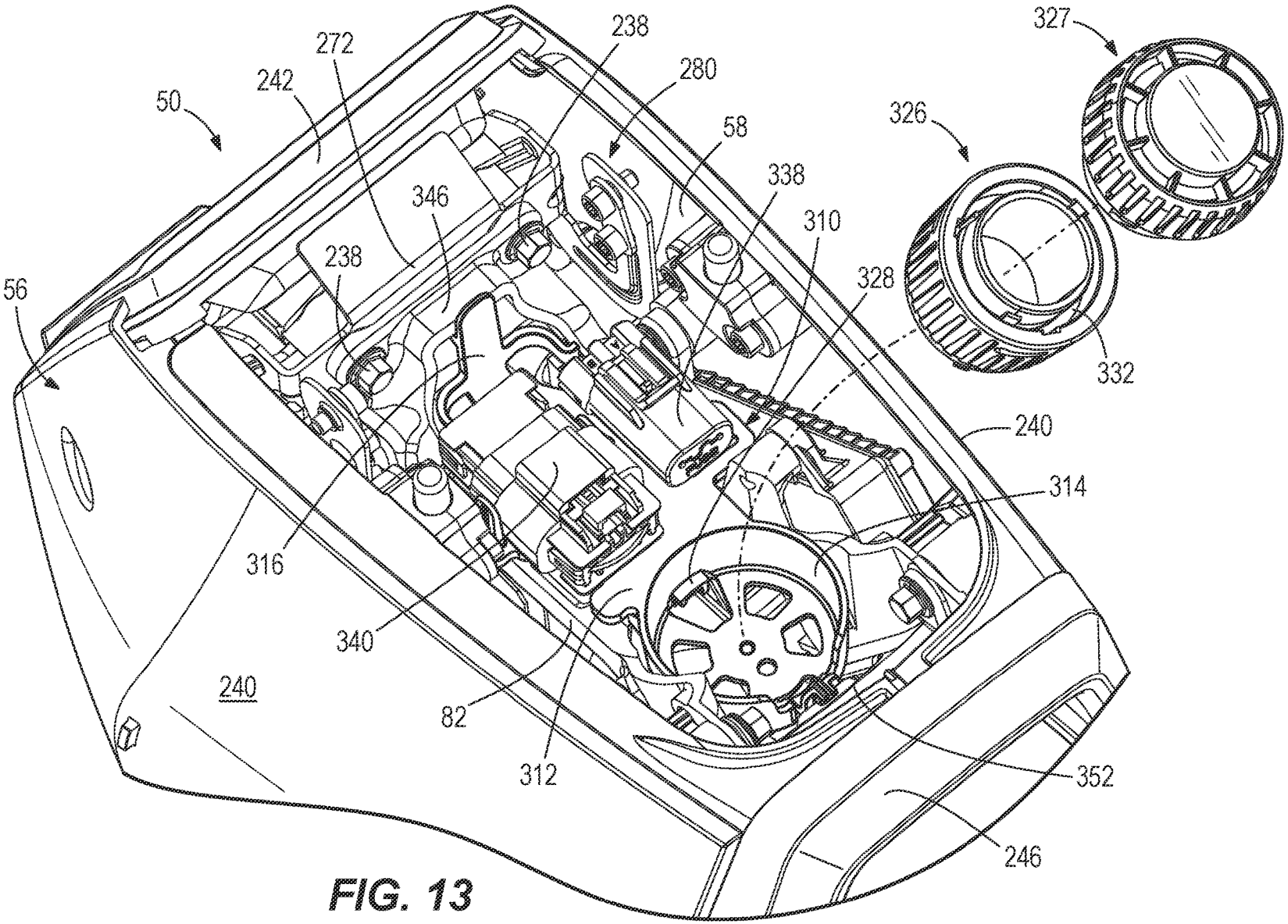
FIG. 13 is a partially exploded perspective view of the service tray of the marine drive of FIG. 12.
Figure 14:
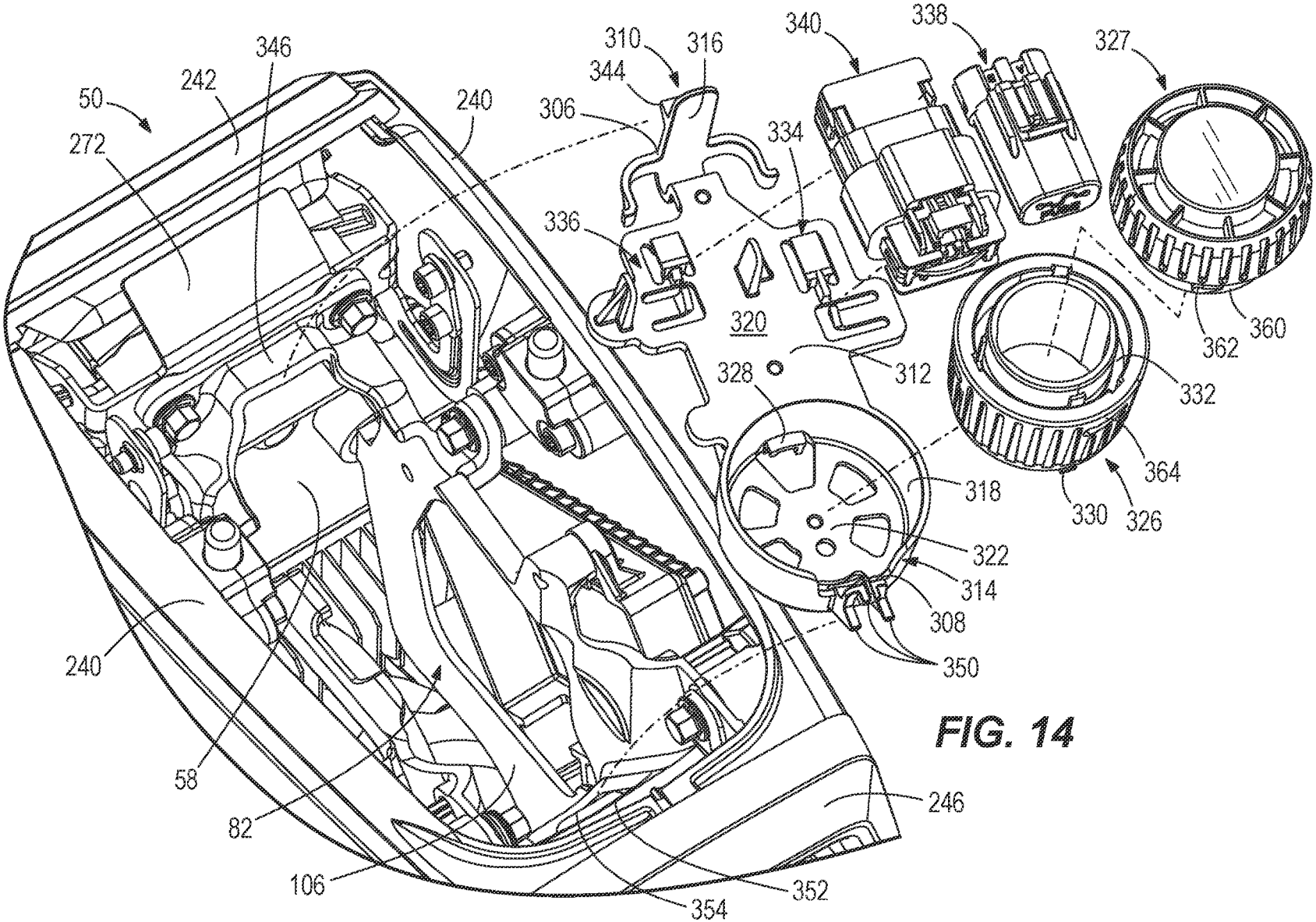
FIG. 14 is an exploded perspective view of the service tray of the marine drive of FIG. 13.
Figure 15:
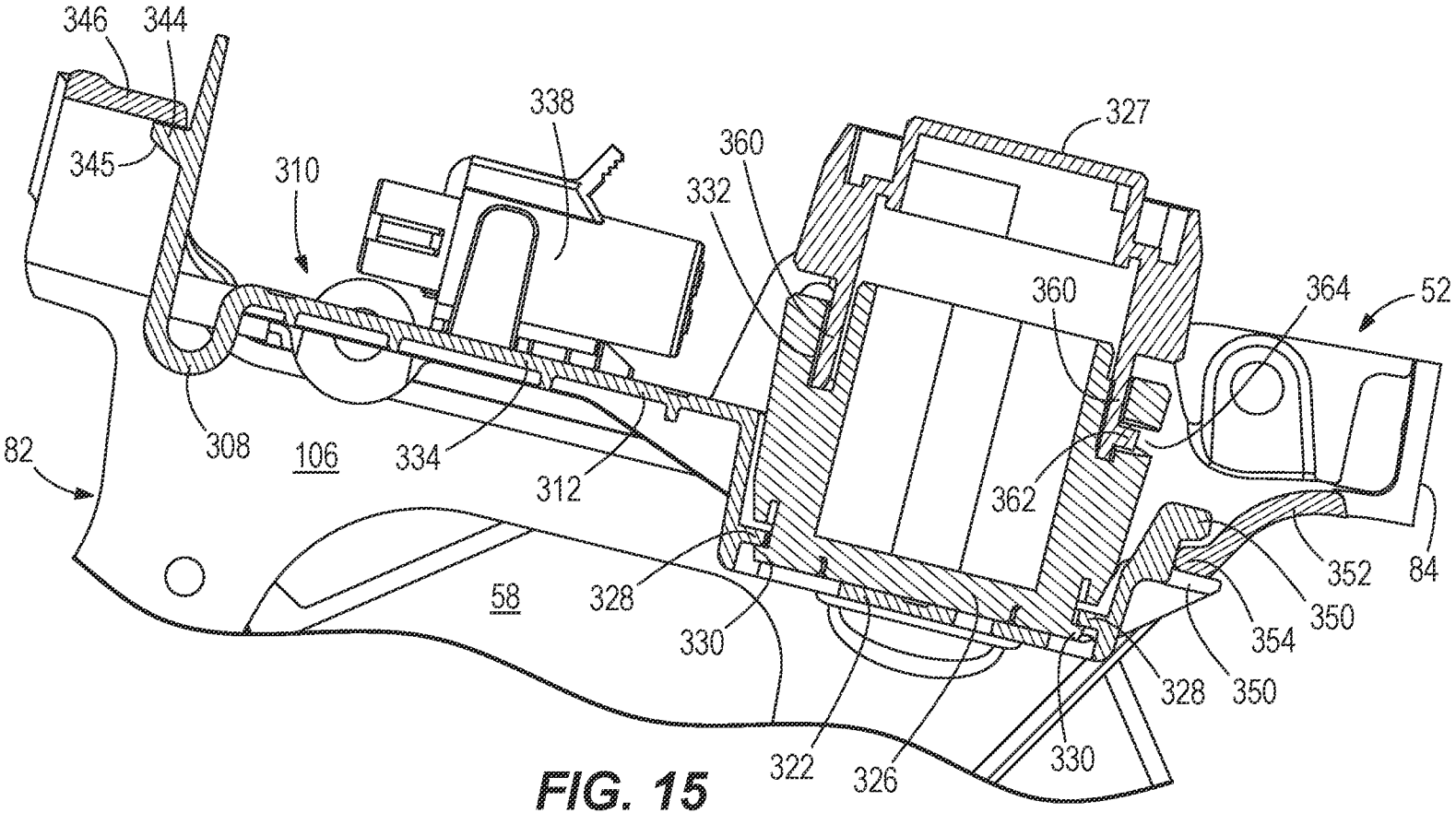
FIG. 15 is a detailed section view of the top end of the marine drive and the service tray, taken at section 9-9 taken in FIG. 8.

Referring to FIGS. 13-15, embodiments of a marine drive 50 may include a service tray 310 that is removably coupled to the top end 92 of the supporting frame 52. The service tray 310 is configured to support at least one serviceable component, and/or a component used when servicing and/or transporting the marine drive 50. At least one of the serviceable components may be removably coupled to the service tray 310. The service tray 310 includes a generally planar body 312 and extends from a storage recess 314 at a front end 306 of the service tray 310 to a locking tab 316 at a rear end 308 of the service tray 310.

The storage recess 314 has cylindrical side walls 318 that extend downwardly from the upper surface 320 of the body 312 to a bottom wall 322. The illustrated storage recess 314 is configured to removably receive two weather caps 326, 327 in a nested arrangement and includes attachment features for retaining the cap(s) 326 in the storage recess 314. For example, as illustrated in FIGS. 14 and 15, the storage recess 314 includes at least one locking member 328 the projects radially inward from the side wall 318 of the storage recess 314 proximate the bottom wall 322. Each locking member 328 corresponds to a locking protrusion 330 that extends radially outward from the outer surface of the first cap 326. The attachment features on the first cap 326 may be engaged with the corresponding attachment features on the service tray 310 by rotating the first cap 326 in the storage recess 314. As the first cap 326 rotates, the locking protrusions 330 on the first cap 326 each slide into a locked position below the corresponding locking member 328 of the service tray 310. Engagement between the locking members 328 and the corresponding locking protrusions 330 couples the first cap 326 to the service tray 310, thereby retaining the first cap 326 in the storage recess 314.

With continued reference to FIGS. 14 and 15, the first cap 326 includes a circular channel 332 that is configured to receive at least a portion of a second cap 327 in a nested arrangement. A generally circular lower wall 360 extends downward from the second cap 327 and is configured to be received in the circular channel 332 of the first cap 326. At least one attachment feature on the lower wall 360 is configured to engage a corresponding attachment feature on the first cap 326 to secure the second cap 327 to the first cap 326. In the illustrated embodiments, at least one protrusion 362 projects outward from a radially outer surface of the lower wall 360. Each of the protrusions 362 is teardrop-shaped and corresponds to a slot 364 formed in the side wall of the first cap 326. When the lower wall 360 of the second cap 327 is received in the circular channel 332 of the first cap 326, the second cap 327 can be rotated to slide the teardrop-shaped protrusion(s) 362 into the corresponding slot(s) 364 to couple the second cap 327 to the first cap 326, thereby coupling the second cap 327 to the service tray 310. The teardrop shape facilitates the engagement and prevents undue wear of the interface of these components. Thus, the two caps 326, 327 may be stored in the storage recess 314 simultaneously.

In the illustrated embodiments, the first cap 326 is configured as a weather cap configured to be mounted on the electrical connector port 220 to seal the electrical connector port 220 when the marine drive 50 is not in use. This may be useful, for example, to prevent the ingress of water or debris into the electrical connector port 220, in particular while transporting the marine drive 50. The second cap 327 may be configured to me mounted on the electrical connector port 220 on the marine drive 50, an electrical connector port on a remote power source, or any other sealable opening or connecting port. Other embodiments, however, may include at least one first or second cap configured to seal a different port or opening on the marine drive 50. Additionally or alternatively, at least one of the service tray 310, the first cap 326, and the second cap 327 may include a differently configured attachment feature for coupling the first cap 326 and the service tray 310 and/or the first cap 326 and the second cap 327.

Between the storage recess 314 and the locking tab 316, at least one mounting feature for removably coupling at least one serviceable component to the service tray 310. In the illustrated embodiments, for example, the service tray 310 includes first and second locking features 334, 336 formed on the upper surface 320 of the body 312. The first mounting feature 334 removably couples a fuse 338 to the service tray 310. The second mounting feature 336 removably couples an electronic service tool connector 340, which is configured to connect the marine drive 50 to a diagnostic service tool (not shown), to the service tray 310.

In the illustrated embodiments, the service tray 310 is configured to be coupled and decoupled from supporting frame 52 without use of tools. A plurality of teeth 350 extend forward from the front end 306 of the service tray 310 and are configured to engage a lip 354 of a laterally extending member 352 of the body 82 of the supporting frame 52. Referring to FIG. 15, the locking tab 316 is resiliently deformable and extends upward from the body 312. A protrusion 344 projects rearwardly from the locking tab 316 and is configured to engage a lip 346 of the mounting bracket 272 of the supporting frame 52 to secure the service tray 310 thereto.

To connect the service tray 310 to the supporting frame 52, the service tray 310 is inserted into the marine drive so that the teeth 350 engage the edge of the laterally extending member 352 of the body 82. The service tray 310 may then be pivoted downward to engage the locking tab 316 with the lip 346 of the mounting bracket 272. As the service tray 310 is pivoted downward, a ramped lower surface 345 of the protrusion 344 abuts the lip 346, biasing the locking tab 316 towards the front end 306. Once the protrusion 344 has moved past the lip 346, the locking tab 316 returns to its original position, thereby engaging the protrusion 344 with the lip 346 and coupling the service tray 310 to the top end 92 of the supporting frame 52. To remove the service tray 310 from the supporting frame 52, the locking tab 316 can be pressed in a forward direction to disengage the protrusion 344 from the lip 346 of the mounting bracket 272. The service tray 310 and any attached components (e.g., the caps 326, 327, the fuse 338, and/or the electronic service tool connector 340) can be pivoted and lifted from the body 82 of supporting frame 52 and removed from the interior of the marine drive 50.

As previously mentioned, the lid 248 of the cowling 56 can be moved into an open position in which the body 82 of the supporting frame 52 is accessible via the open lid 248. Thus, when in the open position, lid 248 provides service access to the service tray 310, the fuse 338, the electronic service tool connector 340, and the cap 326. This may be useful, for example, so that the service tray 310, the fuse 338, the electronic service tool connector 340, and/or the caps 326, 327 may be removed from the body 82 via the lid 248.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An outboard marine drive comprising:

a monolithic supporting frame for supporting the outboard marine drive relative to a marine vessel, the monolithic supporting frame having a body, a support leg extending downwardly from the body and configured to support a propulsor housing for a propulsor configured to generate a thrust force in water, and a steering arm extending forwardly from the body for steering of the outboard marine drive;

a cowling having a lid that is movable into and between a closed position enclosing the body and an open position providing access to the body;

a service tray removably coupled to the body of the monolithic supporting frame; and a fuse coupled to the service tray, wherein the lid in the open position provides access to the service tray and the fuse.

2. The outboard marine drive according to claim 1, wherein the fuse is removably coupled to the service tray without use of tools.

3. The outboard marine drive according to claim 1, wherein the service tray is configured for coupling to and decoupling from the monolithic supporting frame without use of tools.

4. The outboard marine drive according to claim 1, wherein the service tray is removable from the body when the lid is in the open position.

5. An outboard marine drive comprising:

a monolithic supporting frame for supporting the outboard marine drive relative to a marine vessel, the monolithic supporting frame having a body, a support leg extending downwardly from the body and configured to support a propulsor housing for a propulsor configured to generate a thrust force in water, and a steering arm extending forwardly from the body for steering of the outboard marine drive;

a cowling having a lid that is movable into and between a closed position enclosing the body and an open position providing access to the body;

a service tray removably coupled to the body of the monolithic supporting frame; and an electronic service tool connector coupled to the service tray, wherein the lid in the open position provides access to the service tray and the electronic service tool connector.

6. The outboard marine drive according to claim 5, wherein the electronic service tool connector is removably coupled to the service tray without use of tools.

7. The outboard marine drive according to claim 5, wherein the service tray is configured for coupling to and decoupling from the monolithic supporting frame without use of tools.

8. The outboard marine drive according to claim 5, wherein the service tray is removable from the body when the lid is in the open position.

9. An outboard marine drive comprising:

a monolithic supporting frame for supporting the outboard marine drive relative to a marine vessel, the monolithic supporting frame having a body, a support leg extending downwardly from the body and configured to support a propulsor housing for a propulsor configured to generate a thrust force in water, and a steering arm extending forwardly from the body for steering of the outboard marine drive;

a cowling having a lid that is movable into and between a closed position enclosing the body and an open position providing access to the body;

a service tray removably coupled to the body of the monolithic supporting frame; and a weather cap coupled to the service tray, wherein the lid in the open position provides access to the service tray and the weather cap, for removal and mounting of the weather cap on an electrical connector port for providing power to the propulsor.

10. The outboard marine drive according to claim 9, wherein the weather cap is removably coupled to the service tray without use of tools.

11. The outboard marine drive according to claim 9, wherein the service tray is configured for coupling to and decoupling from the monolithic supporting frame without use of tools.

12. The outboard marine drive according to claim 9, wherein the service tray is removable from the body when the lid is in the open position.

* * * * *